United States Patent [19]

Wojtanek

[11] 4,412,110

[45] Oct. 25, 1983

[54] TIMER CLUTCH

[75] Inventor: Guy A. Wojtanek, Franklin Park, Ill.

[73] Assignee: The Singer Company, Stamford, Conn.

[21] Appl. No.: 370,612

[22] Filed: Apr. 22, 1982

[51] Int. Cl.[3] ..... H01H 43/00

[52] U.S. Cl. ..... 200/38 R; 200/38 A; 200/38 C

[58] Field of Search ..... 200/35 R, 37 R, 38 R, 200/38 A, 38 B, 38 BA, 38 C, 38 CA, 283; 74/568 T, 568 M

[56] References Cited

U.S. PATENT DOCUMENTS

| | | | |
|---|---|---|---|
| 3,159,255 | 12/1964 | Woolley | 200/38 R X |
| 3,390,243 | 6/1968 | Obermann | 200/283 |
| 3,586,797 | 6/1971 | Gerhardt et al. | 200/38 CA |
| 3,819,886 | 6/1974 | Homan et al. | 200/38 B |
| 4,146,760 | 3/1979 | Voland | 200/38 B X |
| 4,149,046 | 4/1979 | Bolin | 200/38 C |

*Primary Examiner*—J. R. Scott

*Attorney, Agent, or Firm*—David L. Davis; Robert E. Smith; Edward L. Bell

[57] ABSTRACT

When the axially movable shaft mounted in the hub of a program cam drum is moved inwardly a pin loosely mounted in a cross hole on the shaft will move into engagement with teeth on a drive sleeve mounted between the shaft and the drum hub while a washer fixed on the end of the shaft moves to actuate a slider which then actuates and opens a line switch to take power off the appliance controlled by the timer. Engagement of the pin with the sleeve completes the drive to the sleeve and the sleeve is keyed to the drum by lugs projecting to slots in the hub. Now the shaft can rotate the timer drum without power applied to the appliance. When the shaft is pulled out, the line switch closes and the drive pin is disengaged from the teeth and rotation of the shaft is not effective to rotate the timer.

5 Claims, 5 Drawing Figures

TIMER CLUTCH

BACKGROUND OF THE INVENTION

Program timers for washing machines and the like generally employ a timing cam which is advanced in a step-by-step or continuous manner to program the various switches controlling the machine functions. Generally a plurality of programs are provided and the user can manually position the timer to start or modify a selected program. During the manual positioning or advance of the timer, all power to the washing machine is cut off by opening a line switch. When the timer has been properly positioned, the knob is moved axially to close the line switch to apply power to the washing machine. Normally, it is desired that the knob be declutched from the timing cam during operation of the timer so the user cannot advance the timer while it is in operation. Thus, if the user wants to make a change, he must again axially actuate the knob to open the line switch and engage the clutch so the knob can turn the timing cam.

Clutching and line switch actuation is accomplished by various mechanisms which work satisfactorily but entail quite a few parts and consequent cost.

SUMMARY OF THE INVENTION

The object of this invention is to provide an improved clutch for engaging and disengaging an axially movable rotatable shaft with a timer program drum and to provide for opening a line switch when the clutch is engaged so power to the appliance is off when the timer is manually advanced. The improvement resides in simplification of prior designs for accomplishing the same purpose. There are fewer parts and assembly is easier. Cost is reduced.

In a broad sense this invention is applicable to any rotary switching arrangement where it is desired to have a push-pull switch function combined with ability to rotate the switch only in one axial position of the actuating shaft.

DETAILED DESCRIPTION OF THE DRAWINGS

Figure 1:
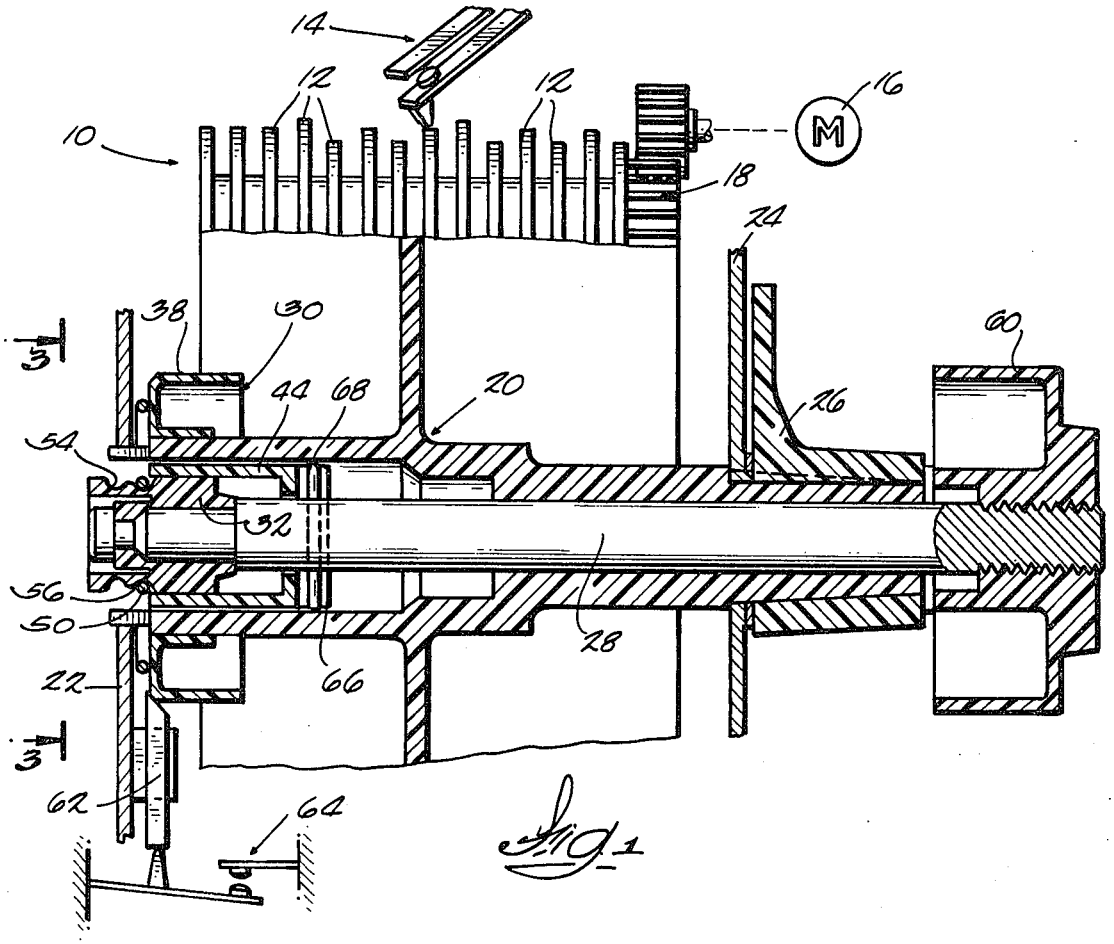
FIG. 1 is a partial vertical section through a timer provided with the improved clutch shown engaged. Some of the parts are shown schematically.
Figure 2:
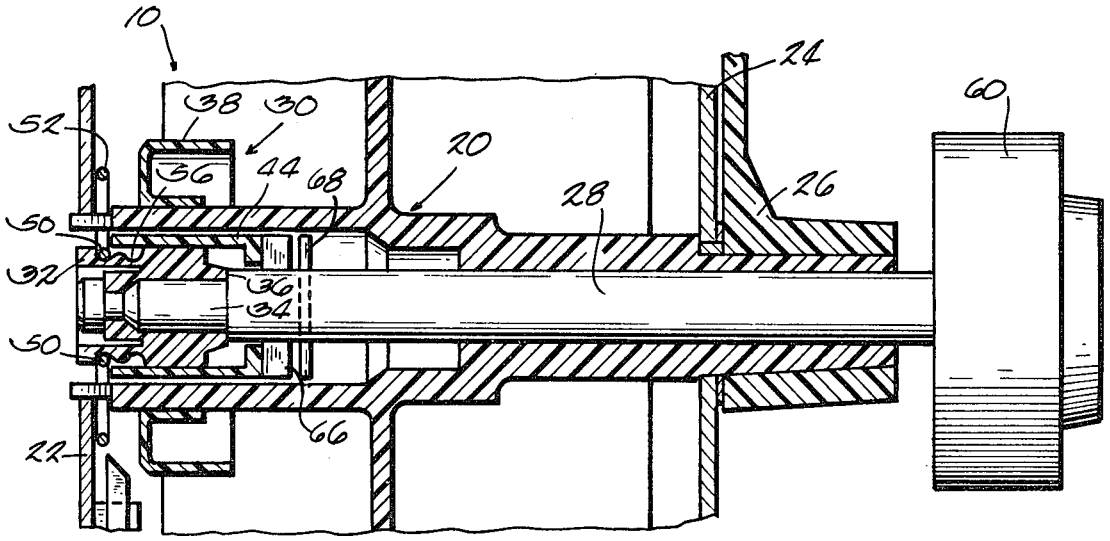
FIG. 2 is a partial vertical section similar to FIG. 1 but shows the clutch disengaged.
Figure 5:
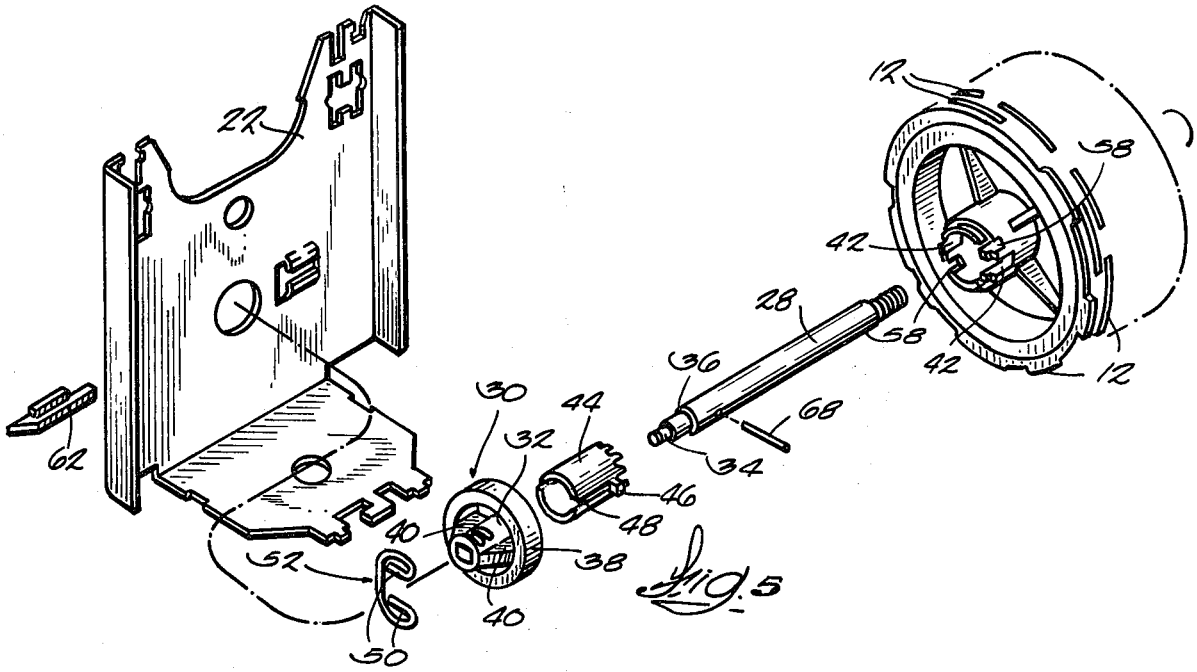
FIG. 5 is an exploded perspective view.
Figure 3:
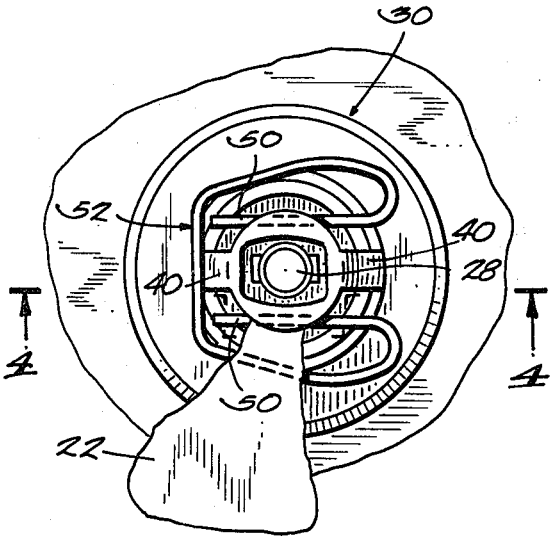
FIG. 3 is a view taken as indicated by line 3—3 in FIG. 1.
Figure 4:
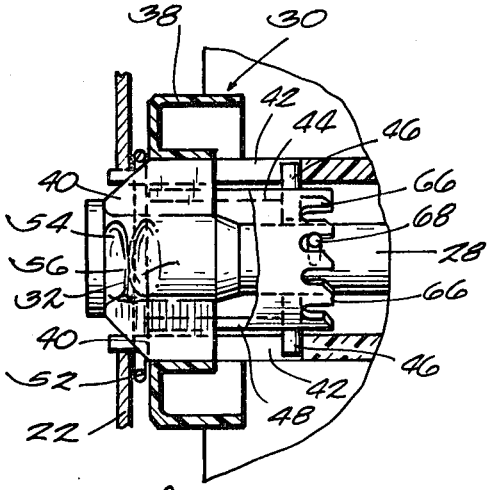
FIG. 4 is a section on line 4—4 in FIG. 3 to show details which do not show in FIGS. 1 and 2.

The drawings are detailed in those parts which relate to the invention and are schematic as to features which are unimportant in understanding the invention. The program drum 10 is molded to provide a multiplicity of timing cams 12 which are contoured to actuate switches 14 in sequence as the drum rotates. The drum is rotated by motor 16 driving the gear 18 molded on the drum. The drive can be step-by-step or continuous as fits the requirements. The drum is molded with a hollow hub 20. The rear of the hub is journaled in the back plate 22 of the timer frame while the front of the hub is journaled in and projects through the front plate 24. In use the hub projecting from the front of the housing will project through the panel of a washing machine and have a pointer 26 mounted on the D-shaped portion of the hub so the pointer is accurately located relative to the drum and serves to indicate the rotary position of the drum relative to markings on the panel.

Shaft 28 is mounted inside hub 20. Washer 30 is mounted on the rear end of the shaft for axial movement with the shaft. The connection of the washer to the shaft permits the shaft to rotate relative to the washer. The connection between the washer and the shaft is simply molded fingers on the inside of the washer hub 32 which snap over the rear end of the shaft to engage the reduced diameter portion 34 with the shaft shoulder 36 engaging the inner end of the hub 32. The annular portion 38 of the washer is connected to the hub 32 by diametrically opposed ribs 40 which fit into the diametrically opposed slots 42 in the rear end of the drum hub 20. This keys the washer 30 to the drum 10 and permits axial movement of the washer relative to the drum.

A drive sleeve 44 fits over the rear end of the shaft inside the drum hub with diametrically opposed lugs 46 engaged with the drum hub slots 42 so the drive sleeve 44 is keyed to the drum 10. The sleeve has opposed slots 48 which are aligned with drum hub slots 42 and receive the washer ribs 40. Forward movement of the sleeve is limited by engagement of the lugs 46 with the end of slot 42. The sleeve is retained in that position by the legs 50 of detent spring 52. The spring legs also engage either of the axially spaced grooves 54, 56 in the washer hub which provide the detent positions of the shaft. The spring lies between the rear end of the drum hub and the back plate with the spring legs passing through the shallow slots 58 in the end of the drum hub to lie behind the drive sleeve in engagement with one of the detent grooves 54, 56.

When the timer is operated the shaft 28 is "out"—the knob 60 threaded on the shaft has been pulled out—so the detent spring 52 engages groove 54. This allows slide 62 to move under the washer 30 to close line switch 64. The inner or forward end of the drive sleeve 44 is provided with multiple teeth 66. A drive pin 68 is loosely mounted in a transverse hole through the shaft 28. When the shaft 28 is "out" the pin 68 is axially spaced from the ends of teeth 66. The shaft 28 can then rotate freely relative to the drum 10. When the shaft 28 is pushed "in" the drive pin 68 will be moved into engagement with the teeth 66 on the end of the drive sleeve 44. The ends of the teeth 66 are sloped or angled to ensure smooth entry of the pin 68 into a pair of slots between the teeth 66. If the pin 68 becomes bent it is able to rotate in the cross hole in the shaft to "find" a position in which it can engage the teeth 66. Now when the knob/shaft rotates, the pin 68 drives the sleeve 44 which drives the drum 10 through the sleeve lugs 46 engaging the drum hub slots 42. When the shaft is moved "in" the washer 30 moves towards the back plate 22 and forces slider 62 outwardly to open the line switch 64. Thus, the line switch is open when the knob is actuated to manually position the timer. In the "in" position of the shaft 28 the detent spring 52 engages groove 56 on the washer hub 32. As the shaft 28 moves between the in and out positions the spring legs 50 are spread apart to pass over the hump between the grooves 54 and 56.

Other methods of operating the line switch in response to axial movement of the shaft can be employed with the present drive—more properly called a clutch—arrangement. The clutch has the advantage of fewer parts than the prior art. The loose mount of the drive pin is a simple assembly operation and once the pin is inside the drum hub it can't fall out. The drive sleeve slides into place easily. Even if the pin gets bent it can adjust to complete the drive or "get out of the way" of the teeth when in the "out" position.

I claim:

1. In a timer including a program cam drum having a hollow hub rotatably mounted between support plates, a shaft mounted in said drum for axial movement between first and second positions, switch means for controlling the application of power to said timer, and switch actuating means on one end of the shaft, the improvement comprising, a sleeve between the shaft and the drum hub adjacent said one end of the shaft, means rotatably connecting the sleeve to the drum hub, a plurality of axially extending teeth on one end of the sleeve, and a pin mounted in a transverse hole through the shaft inside the hub, the pin being free to rotate within the hole and retained lengthwise in the hole by engagement of its ends with the interior of the hub, said pin being axially spaced from the confronting end of the sleeve in said first axial position of the shaft and engaging said teeth in the end of the sleeve when the shaft is in said second axial position.

2. A timer according to claim 1 in which the switch actuating means comprises an annular washer fitted over said hub and connected to said one end of said shaft for axial movement therewith.

3. A timer according to claim 2 in which the annular washer is connected to the shaft by ribs passing through slots in said drum hub and terminating at an integral washer hub which is axially but not rotatably fixed to the shaft, whereby the annular washer is constrained to rotate with said drum hub.

4. A timer according to claim 3 in which the washer hub has axially spaced grooves formed therein, detent spring means axially fixed relative to said drum and engageable with said grooves, said means rotatably connecting the sleeve to the drum hub comprising lugs projecting from the sleeve through said slots in the drum hub, said spring means engaging said sleeve to retain the sleeve in axial position with the lugs engaging the ends of the slots in the drum hub.

5. A timer according to claim 4 in which the sleeve has slots aligned with the slots in the drum hub, said washer ribs passing through said sleeve slots as well as said drum hub slots.

* * * * *